US006897789B2

(12) United States Patent
Lim

(10) Patent No.: US 6,897,789 B2
(45) Date of Patent: May 24, 2005

(54) SYSTEM FOR DETERMINING KIND OF VEHICLE AND METHOD THEREFOR

(75) Inventor: Dae-Woon Lim, Anyang (KR)

(73) Assignee: LG Industrial Systems Co., Ltd., Seoul (KR)

( * ) Notice: Subject to any disclaimer, the term of this patent is extended or adjusted under 35 U.S.C. 154(b) by 214 days.

(21) Appl. No.: 10/391,782

(22) Filed: Mar. 20, 2003

(65) Prior Publication Data

US 2003/0189500 A1 Oct. 9, 2003

(30) Foreign Application Priority Data

Apr. 4, 2002 (KR) ..... 10-2002-0018700

(51) Int. Cl.[7] ..... G08G 1/054

(52) U.S. Cl. ..... 340/937; 340/928; 340/933; 701/117; 348/148; 348/149

(58) Field of Search ..... 340/928, 933, 340/937; 701/117; 348/148, 149

(56) References Cited

U.S. PATENT DOCUMENTS 5,083,200 A * 1/1992 Deffontaines ..... 348/148
5,446,291 A * 8/1995 Becker et al. ..... 250/559.24
5,750,069 A * 5/1998 Lew et al. ..... 340/933
5,809,161 A * 9/1998 Auty et al. ..... 382/104
5,948,035 A * 9/1999 Tomita ..... 701/70
6,195,019 B1 * 2/2001 Nagura ..... 340/928
2001/0022551 A1 * 9/2001 Barnett ..... 340/442

* cited by examiner

*Primary Examiner*—Daniel J. Wu
*Assistant Examiner*—Samuel J. Walk
(74) *Attorney, Agent, or Firm*—Greenblum & Bernstein, P.L.C.

(57) ABSTRACT

A system for determining a kind of vehicle and a method therefore, including a vehicle detection unit for detecting a vehicle which reaches to a vehicle detection region on a roadway, a wheel shaft number counting unit for counting a number of wheel shafts of the detected vehicle, an image photographing unit for photographing a front or rear image of the detected vehicle and a vehicle kind determination unit for yielding distances and widths of the tires of the detected vehicle on the basis of the photographed image from the image photographing unit and determining the kind of the vehicle on the basis of the number of wheel shafts detected from the wheel shaft counting unit and the yielded distance and width values can precisely determine the kind of vehicle traveling the roadway.

12 Claims, 7 Drawing Sheets

FIG. 7

| KIND OF VEHICLE | CLASSIFIED NAME | TIRE DISTANCE | TIRE WIDTH | NUMBER OF WHEEL SHAFTS | REMARK |
|---|---|---|---|---|---|
| 1 | SMALL | | 279.4mm OR SMALLER | 2 SHAFTS | PASSENGER VEHICLE,VAN OF 16 OR FEWER PEOPLE |
| 2 | MEDIUM | 1800mm OR SMALLER | 279.4mm OR LARGER | 2 SHAFTS | VAN OF 17 TO 32 PEOPLE, FREIGHT VEHICLE OF 2.5 TO 5.5 TONS |
| 3 | LARGE | LARGER THAN 1800mm | LARGER THAN 279.4mm | 2 SHAFTS | VAN OF 33 OR MORE PEOPLE |
| 4 | LARGE FREIGHT VEHICLE | | | 3 SHAFTS | FREIGHT VEHICLE OF 10 TO 20 TONS |
| 5 | SPECIAL LORRY | | | 4 SHAFTS | FREIGHT VEHICLE OF 20 OR MORE TONS |
| 6 | SUB-COMPACT VEHICLE | | | 2 SHAFTS | DISCOUNT VEHICLE |

SYSTEM FOR DETERMINING KIND OF VEHICLE AND METHOD THEREFOR

BACKGROUND OF THE INVENTION

1. Field of the Invention

The present invention relates to a toll collection system in a vehicle toll roadway and particularly, to a system for determining a kind of vehicle which travels on a roadway by being applied to the toll collection system and a method therefor.

2. Description of the Related Art

Recently, efforts to adopt an intellectual traffic system are tried in the world. For instance, recently, an electronic toll collection system (hereinafter, as ETCS) which is a system for automatically collecting toll, capable of relieving a problem of vehicle congestion at tollgates which is generated in current manual toll collection systems (hereinafter, as TCS), reducing operating maintenance cost and improving services, by reducing logistics costs, improving environmental condition and computerizing toll collection.

The electronic toll collection system is designed to wirelessly collect toll by using dedicated small region communication (hereinafter, as DSRC) under the condition that a vehicle travels without stopping when passing through a toll gate. However, there has been no way to accurately check toll vehicles and toll-free vehicles with the wireless communication. For instance, in case a large bus in which an on board unit (hereinafter, as OBU; a terminal which is installed inside a vehicle for wirelessly communicating and billing) of a small passenger vehicle is installed passes an automatic toll collection system, whether the small passenger vehicle passed the system or the larger bus passed the system could not be accurately determined.

Therefore, to improve the above problem, a vehicle kind determination device, capable of determining the DSRC for the wireless communication and a kind of vehicle is required.

The vehicle kind determination device measures a height and a width of a vehicle traveling a roadway, determines a kind of the vehicle by using the measurement result, and detects violation vehicles and regular vehicles by checking vehicle kind information and wireless communication information. Here, the violation vehicle can be a large bus in which the OBU of a small passenger vehicle is installed.

On the other hand, as a vehicle measuring device, there is a contact-type vehicle measuring device which is contacted with a detection object. The contact-type vehicle measuring device uses a method of measuring a vehicle traveling a roadway by using pressure of wheels of the vehicle.

Hereinafter, the conventional contact-type vehicle counting device will be described with reference to FIG. 1.

FIG. 1 is a perspective view showing a vehicle measuring device which uses a tread-board sensor.

As shown in FIG. 1, the contact-type vehicle measuring device is composed of a resistance contact-type tread-board sensor 10 is buried in a roadway where vehicles travel and determines kinds of vehicles by measuring the number of wheel shafts of the vehicle, wheel distance (distance between a center of grounding surface of a left tire and a center of grounding surface of a right tire) and wheel width (width of tire) by measuring change of resistance by wheel pressure of the vehicle passing the resistance contact-type tread-board sensor 10.

However, the conventional contact-type vehicle measuring device using the resistance contact-type tread-board sensor 10 can not measure change of the resistance caused by wheel pressure of the vehicle travelling the roadway at a high speed. In addition, installation space must be secured on the roadway to install guiding facilities such as a traffic island to guide a vehicle to pass a ground so under which the tread-board sensor 10 is buried.

As described above, the conventional art damaged the roadway by burying the tread-board sensor and it was difficult to repair the tread-board sensor buried in the roadway when the tread-board sensor is out of order.

Also, since the tread-board sensor in accordance with the conventional art is a contact type, the number of the usage is limited, and the kind of the vehicle traveling the roadway at a high speed can not be precisely determined.

SUMMARY OF THE INVENTION

Therefore, an object of the present invention is to provide a system for determining a kind of vehicle and a method therefor, capable of detecting the number of wheel shafts of a vehicle with a laser sensor or an optical sensor, detecting distance and width of tires of the vehicle by obtaining an image of the vehicle, and precisely determining a kind of a vehicle traveling on a roadway at a high speed on the basis of the detected number of wheel shafts, distance and width values of the tires.

To achieve these and other advantages and in accordance with the purpose of the present invention, as embodied and broadly described herein, there is provided a system for determining a kind of vehicle, including a vehicle detection unit for detecting a vehicle which reaches to a vehicle detection region on a roadway, a wheel shaft number counting unit for counting a number of wheel shafts of the detected vehicle, an image photographing unit for photographing a front or rear image of the detected vehicle and a vehicle kind determination unit for yielding distances and widths of the tires of the detected vehicle on the basis of the photographed image from the image photographing unit and determining the kind of the vehicle on the basis of the number of wheel shafts detected from the wheel shaft counting unit and the yielded distance and width values.

To achieve these and other advantages and in accordance with the purpose of the present invention, as embodied and broadly described herein, there is provided a method for determining a kind of vehicle, including the steps of counting a number of vehicles which travel on a roadway with an optical sensor, yielding the distance and width of tires of the vehicle on the basis of the photographed image and determining the kind of vehicle by comparing the counted number of wheel shafts and the yielded distance and width values with a vehicle kind classification table which is pre-stored.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 7 is a view showing a vehicle kind classification table; and

DETAILED DESCRIPTION OF THE PREFERRED EMBODIMENTS

Reference will now be made in detail to the preferred embodiments of the present invention, examples of which are illustrated in the accompanying drawings.

Hereinafter, a system for determining a kind of vehicle and a method therefor, capable of detecting the number of the wheel shafts of a vehicle with a laser sensor, detecting a distance and a width of tires of the vehicle by obtaining an image of the vehicle, and determining a kind of a vehicle traveling a roadway at a high speed on the basis of the number of the detected wheel shafts, distance and width values of the tires will be described with reference to FIGS. 2 to 8.

Figure 1:
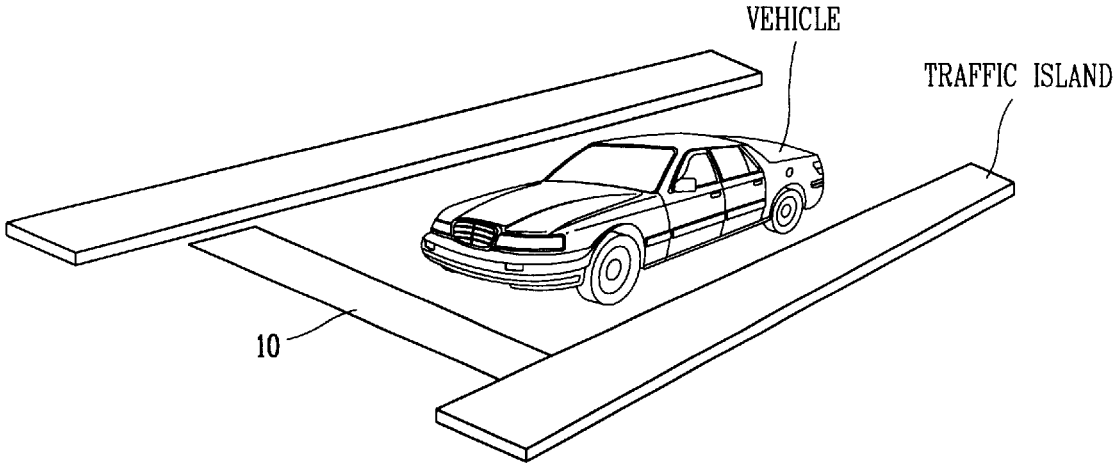
FIG. 1 BACKGROUND ART
FIG. 1 is a perspective view showing a vehicle measuring device using a tread-board sensor.
Figure 2:
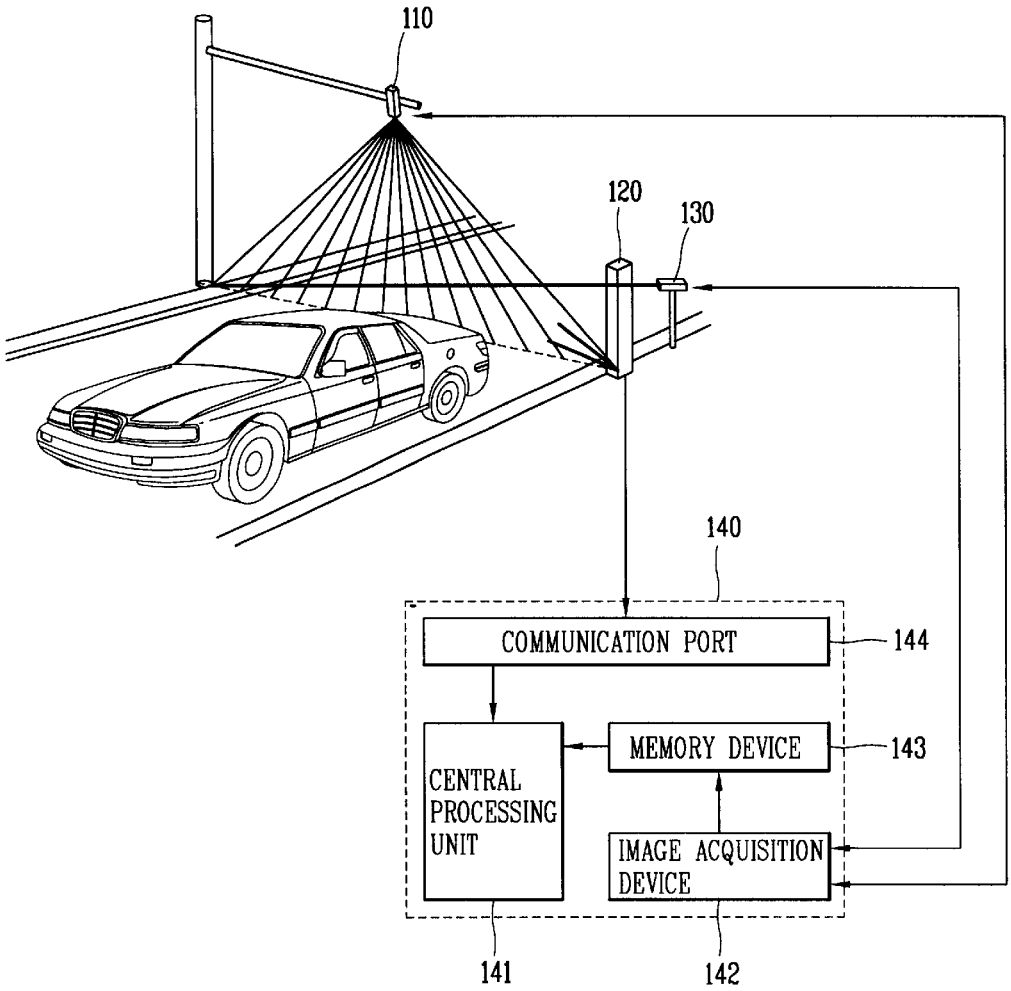
FIG. 2 is a view showing a structure of a vehicle kind determination system in accordance with a first embodiment of the present invention.

FIG. 2 is a view showing a structure of a vehicle kind determination system in accordance with a first embodiment of the present invention.

As shown in FIG. 2, the vehicle kind determination system includes a vehicle detection laser sensor 110 for detecting a vehicle which reaches to the vehicle detection region of a roadway, a wheel shaft counting laser sensor (or wheel shaft counting unit) 120 for generating a laser beam for counting the number of wheel shafts of the vehicle which reaches to the vehicle detection region, a charge coupled device (hereinafter, as CCD) camera 130 for photographing a rear image of a vehicle which moves from the vehicle detection region, and a vehicle kind determination processor (or vehicle kind determination unit) 140 for operating the CCD camera 130 to photograph a rear image of a photographed vehicle when the vehicle reaching to the vehicle detection region is detected by the vehicle detection laser sensor 110, yielding a distance and a width of the tires of the vehicle on the basis of the rear image of the photographed vehicle and determining the kind of the vehicle passing the vehicle detection region on the basis of the number of wheel shafts detected from the wheel shaft counting laser sensor 120, and distance and width values of the yielded tires. Here, the present invention can use a detection unit such as a sensor which can sense a vehicle which travels on a roadway or various materials instead of the vehicle detection laser sensor 110, or can use an image photographing unit such as various cameras, capable of photographing a moving picture or a still image instead of the CCD camera.

On the other hand, the vehicle kind determination processor 140 includes a communication port 144 for receiving a value of number of wheel shafts counted from the wheel shafts counting laser sensor 120, an image acquisition device 142 for operating the CCD camera 130 when a vehicle which reaches to the vehicle detection region is detected by the vehicle detection laser sensor 110 and outputting a rear image of the vehicle photographed in the CCD camera 130, a memory device 143 for storing the rear image of the vehicle outputted from the image acquisition device 142, and a central processing unit 141 for yielding a distance and a width of the tires of the detected vehicle on the basis of the image stored in the memory device 143 and determining a kind of vehicle which reaches to the vehicle detection region by comparing number of the counted wheel shafts received from the wheel shafts counting unit through the communication port and the yielded distance and width the with a stored vehicle kind classification table.

Figure 3:
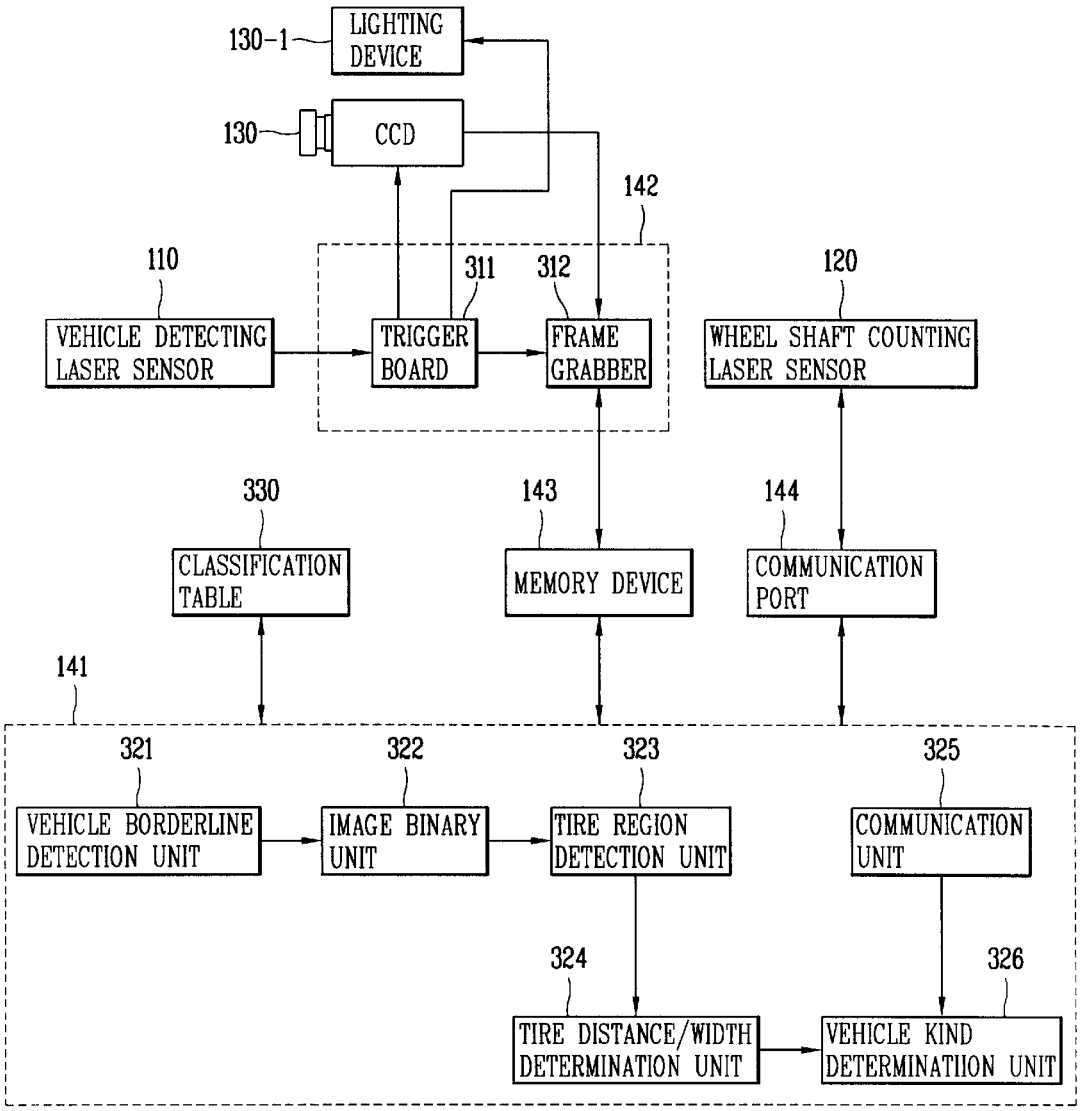
FIG. 3 is a block diagram showing a structure of a vehicle kind determination processor of FIG. 2 in detail.

Hereinafter, a structure of the vehicle kind determination processor 140 will be described in detail with reference to FIG. 3. FIG. 3 is a block diagram showing the structure of the vehicle kind determination processor of FIG. 2 in detail. Particularly, a structure of the image acquisition device 142 and the central processing device 141 will be described in detail.

As shown in FIG. 3, the image acquisition device 142 of the vehicle kind determining processor 140 includes a trigger board 311 for operating the CCD camera 130 and a lighting device 130-1 when a vehicle which reaches to the vehicle detection region is detected by the vehicle detection laser sensor and a frame grabber 312 for storing an image photographed in the CCD camera 130 in the memory device 143. Here, the lighting device 130-1 emits light to the roadway direction so that the CCD camera can photograph a vehicle which travels the roadway at night.

The central processing device 141 of the vehicle kind determining processor 140 includes a vehicle borderline detection unit 321 for detecting a borderline of a vehicle from a rear image of the vehicle stored in the memory unit 143, an image binarizing unit 322 for binarizing a borderline image detected from the vehicle borderline detection unit 321 with a threshold value, a tire region detection unit 323 for detecting a tire region of the vehicle on the basis of the binary-coded image in the image binarizing unit 322, a tire distance/width determination unit 324 for yielding inner and outer distances of both side tires (wheel distance) of the vehicle on the basis of the tire region detected from the tire region detection unit 323 and yielding the widths of the both side tires (wheel width), a communication unit 325 for receiving the number of wheel shafts counted in the wheel shaft counting laser sensor 120 and a vehicle kind classifying determination unit 326 for determining the kind of the vehicle which reaches to the vehicle detection region by comparing the distance and width values outputted from the tire distance/width determination unit 324 and the number of the wheel shafts received through the communication unit 325 with a vehicle kind classification table pre-stored in a storage unit 330. Here, the communication unit 325 receives the number of wheel shafts from the wheel shaft counting laser sensor 120 through the communication port 144.

Hereinafter, the operation of the vehicle kind determination system in accordance with the first embodiment of the present invention will be described in detail.

Firstly, the vehicle kind determination processor 140 operates the wheel shaft counting laser sensor 120 when a vehicle reaching to the vehicle detection region of the vehicle kind determination system is detected by the vehicle kind determination laser sensor 110.

The wheel shaft counting sensor 120 counts the number of the wheel shafts of the vehicle which passed the vehicle detection region. The method of counting the number of wheel shafts will be described with reference to FIGS. 4A to 4D.

FIGS. 4A to 4D are views showing a method for counting the number of the wheel shafts.

Figure 4A:
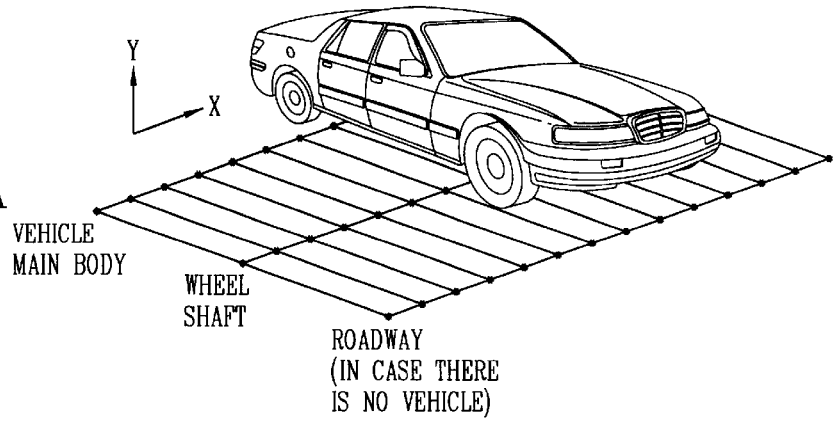
FIGS. 4A to 4D are views showing a method for counting the number of the wheel shafts.

As shown in FIG. 4A, the wheel shaft counting laser sensor 120 emits laser beam in a direction of the roadway at a regular interval along a Y shaft on the basis of the roadway, measures a time until the emitted laser beam is reflected from a surface of the vehicle on the roadway and received, and measures a distance from the wheel shaft counting laser sensor 120 to the vehicle on the basis of the measured time.

Figure 4B:
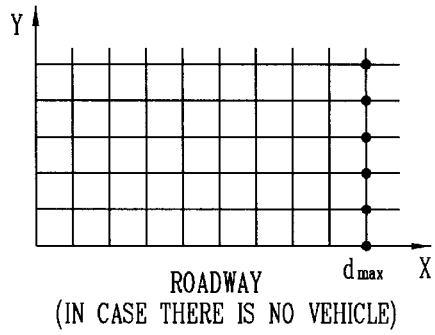
Figure 4C:
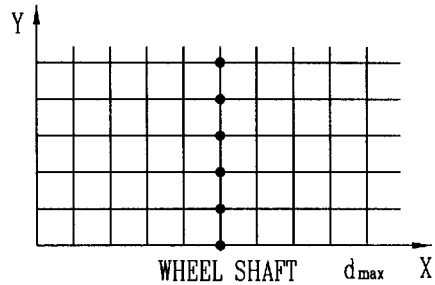
Figure 4D:
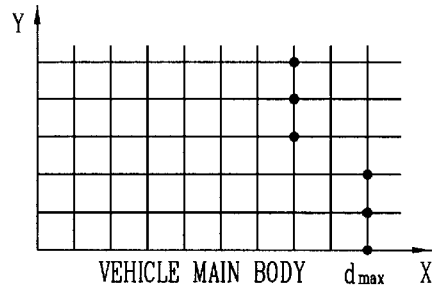

On the other hand, as shown in FIG. 4B, the vehicle kind determination processor 140 determines that there is no vehicle on the roadway in case a laser beam reflected from an object is not received to the wheel shaft counting laser sensor 120 in a predetermined time after the laser beam is emitted from the wheel shaft counting laser sensor 120, and sets the distance as a maximum measurement distance ($d_{max}$). That is, the vehicle kind determination processor 140 classifies the laser signals into signals corresponding to a roadway (in case there is not vehicle), a wheel shaft, and a vehicle main body by using a characteristic of the laser signal indicating that it is reflected from an object and received as shown in FIGS. 4B to 4D.

Also, the image acquisition device 142 of the vehicle kind determination processor 140 operates the CCD camera 130 and lighting device 130-1 when a vehicle which reaches to the vehicle detection region is detected by the vehicle detection laser sensor 110, photographs a rear image of the vehicle, and stores the rear image of the photographed vehicle in the memory device 143. That is, the trigger board 311 of the image acquisition device 142 operates the CCD camera 130 and the lighting device 130-1 when the vehicle detection laser sensor 110 detects the vehicle which reaches to vehicle detection region. At this time, the frame grabber 312 of the image acquisition device 142 stores the rear image of the vehicle photographed from the CCD camera 130 in the memory device 143. The rear image of the vehicle will be described with reference to FIG. 5 as follows.

Figure 5:
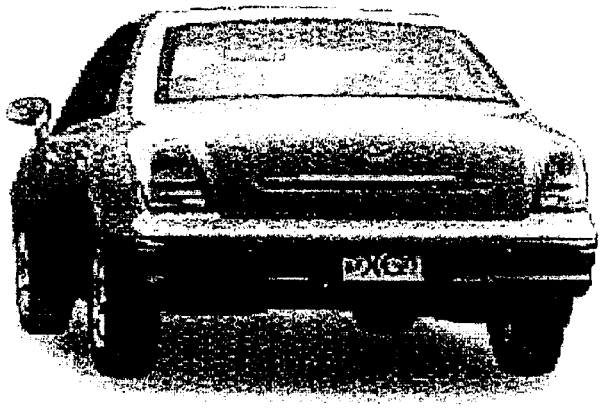
FIG. 5 is an exemplary view showing a rear image of a vehicle.

FIG. 5 is an exemplary view showing the rear image of the vehicle. That is, FIG. 5 is a view showing an image of the rear surface of the vehicle which moves from the vehicle detection region of the vehicle kind determination system photographed with the CCD camera 130.

Then, the central processing device 141 yields distances and widths of the tires of the vehicle from the rear image of the vehicle stored in the memory device 143 and determines the kind of vehicle passing through the vehicle kind detection region, by comparing the number of wheel shafts received from the wheel shaft counting laser sensor 120 through the communication port 144 and the above yielded distance and width values with a vehicle kind classification table which is pre-stored in the classification table storage unit 330.

Hereinafter the operation of the central processing device 141 for precisely determining the kind of the vehicle traveling a roadway at a high speed, including the vehicle borderline detection unit 321, image binary unit 322, tire region detection unit 323, tire distance/width determination unit 324, communication unit 325 and a vehicle kind determination unit 326 will be described in detail.

Firstly, the vehicle borderline detection unit 321 detects a border line of the vehicle from the rear image of the vehicle stored in the memory device 143 and outputs the borderline image of the detected vehicle to the image binary unit 322. That is, the vehicle borderline detection unit 321 detects a borderline of the vehicle by an edge enhancement kernel and convolution operation of the rear image of the vehicle. At this time, the edge enhancement is used as a preliminary step of image characteristic detection, and a "Sobel Kernel" as following formula 1 is used as the edge enhancement kernel.

$$X = \begin{bmatrix} -1 & -2 & -1 \\ 0 & 0 & 0 \\ 1 & 2 & 1 \end{bmatrix}, Y = \begin{bmatrix} 1 & 2 & 1 \\ 0 & 0 & 0 \\ -1 & -2 & -1 \end{bmatrix} \quad \text{Formula 1}$$

Also, a size of an edge detected from the lines is calculated with an operation as following Formula 2.

$$\text{Size of edge} = \sqrt{X^2 + Y^2} \quad \text{Formula 2}$$

Also, the direction is calculated by an operation as following Formula 3.

$$\text{Direction} = \arctan\left(\frac{Y}{X}\right) \quad \text{Formula 3}$$

The image binary unit 322 binarizes the detected borderline image by comparing with a threshold value, and outputs the binary image of the vehicle which is binary-coded to the tire region detection unit 323. Here, the threshold value is one of non-parameters and the detected borderline image can be binarized by using the "Otsu" algorithm which is known as relatively fast and precise. For instance, in case the image value at a coordinate (x, y) in a two-dimensional image is disclosed as f(x, y) and a threshold value for binarization is T, a binarized result value of f(x, y), g(x, y) can be obtained with an operation of following Formula 4.

$$g(x, y) = \begin{cases} 1 \text{ if } (x, y) > T \\ 0 \text{ if } (x, y) \leq T \end{cases} \quad \text{Formula 4}$$

Hereinafter, the binary-coded image will be described with reference to FIG. 6.

Figure 6:
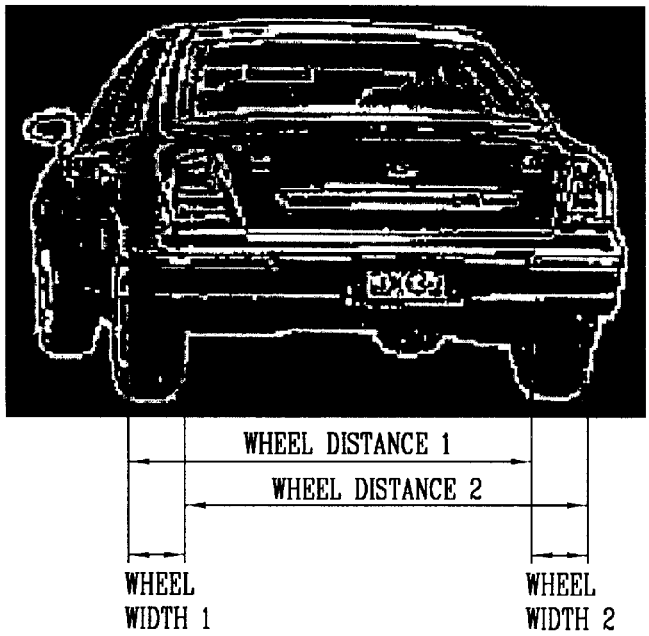
FIG. 6 is a view showing a binary-coded image.

FIG. 6 is a view showing the binary-coded image, that is, a view showing a binary image which is binary-coded by the image binary unit 322.

Then, the tire region detection unit 323 separates the left and right tire regions of the vehicle from the vehicle borderline image which is binary-coded from the image binary unit 322 on the basis of the shape and characteristics of the tires of the vehicle and outputs the separated tire regions to the tire distance/width determination unit 324. That is, since the wheel of the vehicle is positioned at the lowermost end of the vehicle, a tire region of a half-elliptical shape is detected in a lower region of the whole image. At this time, to detect the half-elliptical tire region, a geometric characteristic of the half-elliptical or a template matching algorithm using or a template is used.

The tire distance/width determination unit 324 determines distances and widths of the tires of the vehicle with reference to the separated tire regions. At this time, the tire distance/width determination unit 324 outputs a distance 1 from the outer side of the left tire to the inner side of the right tire and a distance 2 from the inner side of the left tire to the outer side of the right tire, and outputs the yielded distance values (distances 1 and 2) to the vehicle kind determination unit 326. Also, the tire distance/width determination unit 324 yields a width 1 of the left tire and a width 2 of the right tire and outputs the yielded width values (widths 1 and 2) to the vehicle kind determination unit 326.

The vehicle kind determination unit 326 precisely determines the kind of the vehicle traveling the roadway, by comparing the number of wheel shafts of the vehicle which is received from the wheel shaft counting laser sensor 120 and distance and width values yielded from the tire distance/width determination unit 324 with the vehicle kind classification table stored in the classification table storage unit 330. The vehicle kind classification table will be described with reference to FIG. 7.

FIG. 7 is a view showing a vehicle kind classification table. That is, FIG. 7 is a view showing a vehicle kind classification table which is pre-stored in the classification table storage unit 330 to precisely determine the kind of the vehicle on the basis of the number of the wheel shaft of the vehicle and the distance and width values of the tires. Here, the vehicle kind classification table includes tire distances, tire widths, number of wheel shafts and the like.

Hereinafter, the second embodiment of the present invention will be described with reference to FIG. 8. That is, the second embodiment of the present invention replaces the vehicle kind detection laser sensor 110 of FIG. 2 with a vehicle detection optical sensor, and the kind of vehicle can be determined by measuring distances and widths of the tires of the vehicle by photographing a front image of the vehicle when the vehicle reaches to the vehicle detection region.

Figure 8:
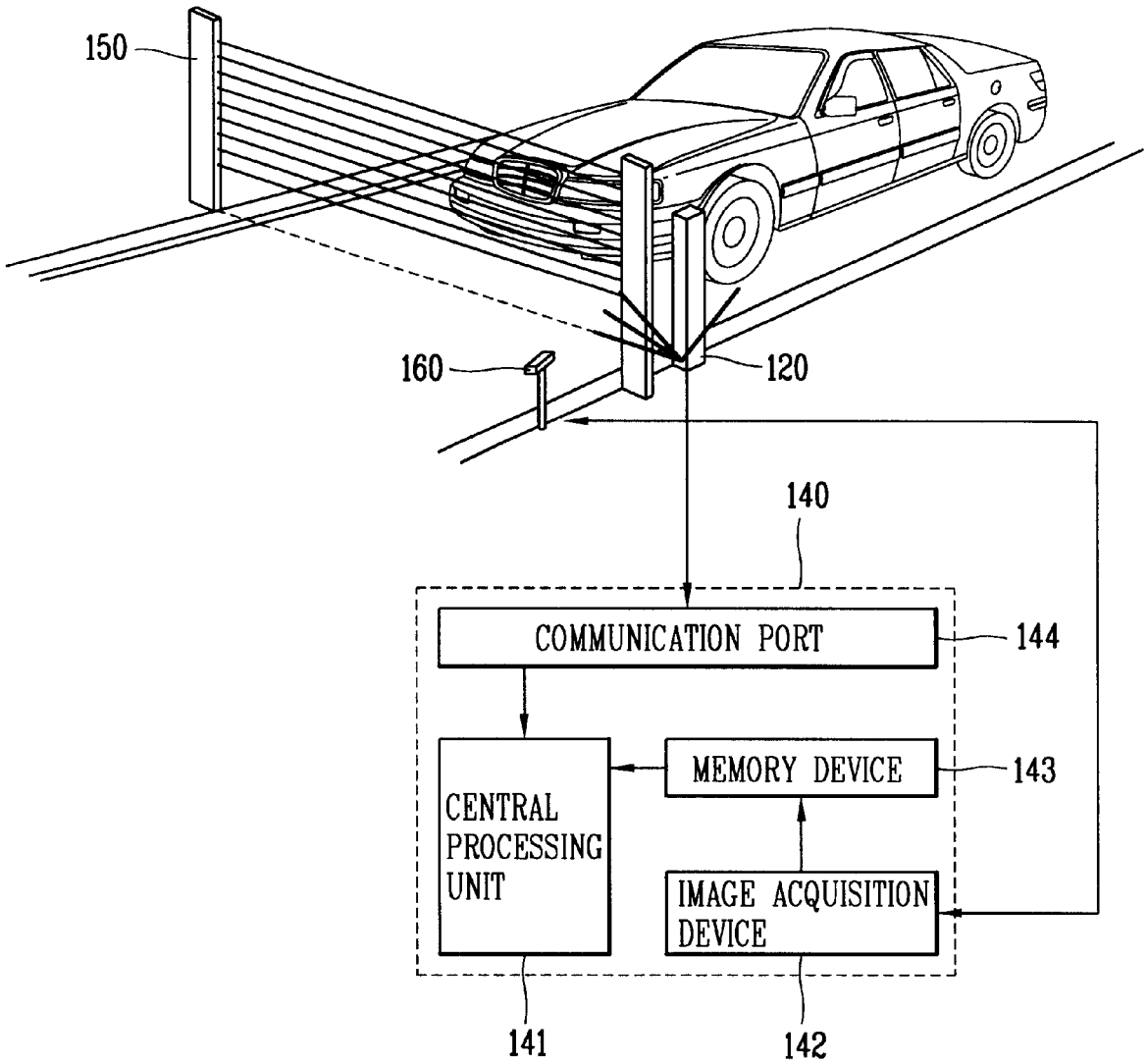
FIG. 8 is a view showing a structure of a vehicle kind determination system in accordance with a second embodiment of the present invention.

FIG. 8 is a view showing a structure of the vehicle kind determination system in accordance with the second embodiment of the present invention.

As shown in FIG. 8, the vehicle kind determination system in accordance with the second embodiment of the present invention includes a vehicle detection optical sensor 150, a wheel shaft counting laser sensor 120, a CCD camera 160 for photographing the front image of the vehicle and a vehicle kind determination processor 140.

The vehicle detection optical sensor 150 is installed at both sides of the roadway, and the CCD camera 160 is installed at a front outer side of the vehicle to be photographed to photograph the front surface of the vehicle. The vehicle kind determination processor 140 includes a central processing device 141, an image acquisition device 142, a communication port 144 and a memory device 143 as identically as the first embodiment of the present invention. Therefore, the description of the vehicle kind determination processor 140 will be omitted.

That is, when the vehicle detection optical sensor 150 in accordance with the second embodiment of the present invention detects the vehicle reaching to the vehicle detection region, the image acquisition device 142 stores a photographed front image in the memory device 143 after photographing the front image of the vehicle by operating the CCD camera 160.

The central processing device 141 yields distances and widths of the tires of the vehicles by an operation identical as the central processing unit 141 of the first embodiment, and determines the kind of vehicle by comparing the yielded distance and width values and the number of wheel shafts of the vehicle counted from the wheel shaft counting laser sensor 120 with the vehicle kind classification table of FIG. 7.

As described above, the present invention detects the number of the vehicle passing through the vehicle detection region of the vehicle kind determination system using a laser sensor or an optical sensor, yields distances and widths of the tires of the vehicle by photographing the front or rear image of the vehicle and precisely determines the kind of the vehicle traveling a roadway at a high speed by determining the kind of the vehicle on the basis of the detected number of wheel shafts and the yielded distance and width values.

Also, the present invention can detect the number of wheel shafts of the vehicle passing through the vehicle detection region of the vehicle kind determination system using a laser sensor or an optical sensor, yield distances and widths of the tires of the vehicle by photographing the front or rear image of the vehicle and precisely determine the kind of the vehicle by comparing the detected number of wheel shafts and the yielded distance and width values with the pre-stored vehicle kind classification table. Therefore, the tread-board sensor is not needed to be buried under the roadway as in the conventional device and damage of the roadway can be prevented.

Also, the present invention can detect the number of wheel shafts of the vehicle passing through the vehicle detection region of the vehicle kind determination system using a laser sensor or an optical sensor, yield distances and widths of the tires of the vehicle by photographing the front or rear image of the vehicle and precisely determine the kind of the vehicle by comparing the detected number of wheel shafts and the yielded distance and width values with the pre-stored vehicle kind classification table. Therefore, maintenance and repair of the vehicle kind classification system of the present invention can be easier than repairing the tread-board buried under in the roadway as conventionally.

Also, the present invention can detect the number of wheel shafts of the vehicle passing through the vehicle detection region of the vehicle kind determination system using a laser sensor or an optical sensor, yield distances and widths of the tires of the vehicle by photographing the front or rear image of the vehicle and precisely determine the kind of the vehicle by comparing the detected number of wheel shafts and the yielded distance and width values with the pre-stored vehicle kind classification table, thus to lengthen a life span of the vehicle kind classification system.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A system for determining a kind of vehicle, comprising:

a vehicle detector that detects a vehicle in a vehicle detection region on a roadway;

a wheel shaft number counter that counts a number of wheel shafts of the detected vehicle;

an image photographing unit that photographs one of a front and a rear image of the detected vehicle; and a vehicle kind determiner that determines distances and widths of tires of the detected vehicle based on the photographed image from the image photographing unit and determines the kind of the vehicle based on the number of wheel shafts detected by the wheel shaft number counter and the determined distance and width values.

2. The system of claim 1, further comprising:

an image acquirer that operates the image photographing unit when a vehicle reaching the vehicle detection region is detected and outputs the image photographed from the image photographing unit.

3. The system of claim 1, wherein the vehicle detector comprises one of optical sensors and laser sensors.

4. The system of claim 1, wherein the wheel shaft number counter comprises laser sensors.

5. The system of claim 1, wherein the vehicle kind determiner comprises:

a vehicle borderline detector that detects a borderline of the vehicle from one of the front and the rear image of the vehicle photographed by the image photographing unit;

an image binarizing unit that binarizes an image of the detected borderline;

a tire region detector that detects at least one tire region of the vehicle based on the binary-coded image; and a tire distance/width determiner that determines the distances and the widths of the tires from the at least one detected tire region;

the vehicle kind determiner determining the kind of the vehicle by comparing the determined distance and width and the number of the counted wheel shafts with a stored vehicle kind classification table.

6. The system of claim 5, wherein the tire distance/width determiner determines distances between inner and outer sides of two tires of the vehicle and a width of each tire.

7. The system of claim 1, wherein the vehicle kind determiner comprises:

a communication port that receives the number of wheel shafts counted by the wheel shaft number counting counter;

an image acquisition device that operates the image photographing unit when the vehicle is detected by the vehicle detector and outputting one of the front and the rear image of the vehicle photographed by the image photographing unit;

a memory for storing one of the front and the rear image of the vehicle output from the image acquisition device;

a central processing unit that determines the distances and widths of the tires of the detected vehicle based on one of the front and the rear image of the vehicle stored in the memory and determines the kind of vehicle in the vehicle detection region by comparing the number of counted wheel shafts received from the wheel shaft number counter through the communication port and the determined distance and width with a pre-stored vehicle kind classification table.

8. The system of claim 7, wherein, the image acquisition device comprises:

a trigger board that operates the image photographing unit when the vehicle is detected by the vehicle detector; and a frame grabber that stores an image photographed by the image photographing unit in the memory.

9. The system of claim 7, wherein the central processing unit comprises:

a vehicle borderline detector that detects a borderline of the vehicle from one of the front and the rear image of the vehicle stored in the memory;

an image binarizing unit for binarizing a borderline image detected from the vehicle borderline detector;

a tire region detector that detects at least one tire region of the vehicle based on the image binary-coded from the image binarizing unit;

a tire distance/width determiner that determines inner and outer distances of the tires of the vehicle based on the tire region detected by the tire region detector and determines the widths of the tires; and a communicator that receives the number of wheel shafts counted by the wheel shaft number counter;

the vehicle kind determiner determining the kind of the vehicle by comparing the distance and width values output from the tire distance/width determiner and the number of wheel shafts received through the communicator with the vehicle kind classification table.

10. A method for determining a kind of vehicle, comprising:

counting a number of wheel shafts of a vehicle on a roadway using an optical sensor;

determining a distance between tires and a width of at least one tire of the vehicle based on a photographed image; and determining the kind of vehicle by comparing the counted number of wheel shafts of the vehicle and the determined distance and width values with a vehicle kind classification table.

11. The method of claim 10, wherein determining the distance and width comprises:

detecting a borderline image of the vehicle from the photographed image;

binarizing the borderline image;

detecting at least one tire region of the vehicle based on the binary coded image; and determining the distance and width based on at least one detected tire region.

12. The method of claim 11, wherein determining the distance and width based on the at least one detected tire region comprise determining a distance between an inner side of a first tire and an outer side of a second tire of the vehicle and determining a width of the tires based on the determined distance.

* * * * *

UNITED STATES PATENT AND TRADEMARK OFFICE

CERTIFICATE OF CORRECTION

PATENT NO. : 6,897,789 B2
DATED : May 24, 2005
INVENTOR(S) : D. W. Lim

It is certified that error appears in the above-identified patent and that said Letters Patent is hereby corrected as shown below:

Column 9,
Line 25, after "number" delete "counting".

Signed and Sealed this

Twenty-first Day of March, 2006

JON W. DUDAS
*Director of the United States Patent and Trademark Office*